United States Patent [19]

Yu et al.

[11] Patent Number: 4,759,540

[45] Date of Patent: Jul. 26, 1988

[54] COMPACT STRUCTURE FOR A TREADMILL

[75] Inventors: Chi-Tsung Yu; Ching-Fong Chen, both of Chu Tung, Taiwan

[73] Assignee: Industrial Technology Research Institute, Shin Chu Hsien, Taiwan

[21] Appl. No.: 903,725

[22] Filed: Sep. 5, 1986

[51] Int. Cl.[4] ..... A63B 23/06

[52] U.S. Cl. ..... 272/69; 272/DIG. 4

[58] Field of Search ..... 272/69, DIG. 4; 254/98, 254/424; 74/689; 474/1, 2, 69, 26; 24/580, 583, 596; 403/324, 327, 328, 240

[56] References Cited

U.S. PATENT DOCUMENTS

| | | | |
|---|---|---|---|
| 2,969,768 | 1/1961 | Grant | 272/69 X |
| 3,214,187 | 10/1965 | Fuerst | 403/328 X |
| 3,472,539 | 10/1969 | Fenwick | 403/328 X |
| 3,479,908 | 11/1969 | Kress et al. | 74/689 |
| 3,650,529 | 3/1972 | Salm et al. | 272/69 |
| 3,711,812 | 1/1973 | Cherry | 272/69 X |
| 4,055,329 | 10/1977 | Hammond | 254/424 |
| 4,344,616 | 8/1982 | Ogden | 272/69 |
| 4,378,199 | 3/1983 | Hesler | 474/26 |
| 4,406,451 | 9/1983 | Gaetano | 272/69 |
| 4,635,927 | 1/1987 | Shu | 272/69 |
| 4,635,928 | 1/1987 | Ogden et al. | 272/69 |
| 4,643,418 | 2/1987 | Bart | 272/69 |

*Primary Examiner*—Richard J. Apley
*Assistant Examiner*—David J. Bender
*Attorney, Agent, or Firm*—Cushman, Darby & Cushman

[57] ABSTRACT

A compact structure for a treadmill includes an improved mechanism for adjusting the slope of the treadmill and an improved arrangement for transmitting power to the tread belt. A snap connection is provided between the handrail and control unit support so that those two elements can be quickly disconnected and folded down when the treadmill is to be stored or moved.

1 Claim, 4 Drawing Sheets

COMPACT STRUCTURE FOR A TREADMILL

BACKGROUND OF THE INVENTION

This invention is substantially an improvement over the invention set forth in U.S. patent application Ser. No. 813,655, which was filed on Dec. 26, 1985 by Jia-Ming Shyu under the title of "Automatic Treadmill". The aforesaid disclosure provides a treadmill with the features of controlling, detecting and displaying the exercise data with a micro-computer. The present invention relates to the improvements on the driving and slope adjusting mechanism of the tread belt, and the snap connection and disconnection device between the micro-computer control unit support and the handrail. These means are certainly suitable for other kinds of treadmills.

For conventional treadmills, the transmission mechanism of the tread belt may contain stepped wheels for the stage transmission only.

In order to obtain a stepless transmission, a transmission motor, such as a DC motor or an AC motor controlled with a frequency-changing controller, has to be used; however, either the DC motor or the frequency-changing unit will take up a considerable space within the machine. Moreover, the AC motor controlled with the frequency-changing unit would suffer from insufficient torsional force at a low speed, i.e. being unable to start at zero speed and to operate at a low speed.

SUMMARY OF THE INVENTION

A primary object of the present invention is to provide a mechanical transmission mechanism, which can make the tread belt generate a speed range from zero to a stepless high gear while the motor runs at a constant speed.

Another object of the present invention is to simplify the structure of the machine, and to reduce the dimensions of the machine, including having the runway-slope adjusting mechanism under the runway, and having the handrail and the control unit support folded to the runway surface, if necessary.

In U.S. patent application Ser. No. 813,655 and other conventional treadmills, the slope adjusting mechanism of the runway is vertically mounted on the machine, comprising a rack or a screw rod. That vertical adjusting mechanism takes more space in the machine for increase in the height of the machine.

In the present invention, the slope-adjusting mechanism is substantially a joint mechanism which is mounted under the runway without having any parts projected above the runway; therefore, the runway structure is simpler.

Further, the control unit and the handrail of conventional treadmills are either fixedly mounted on the runway frame, or only a small adjustment of the height and angle can be made. As a result, the whole structure of the machine takes more space for storage or shipping or handling. As for the present invention, since some of its parts are foldable, the dimensions of the machine has been considerably reduced.

DETAILED DESCRIPTION

Figure 1A:
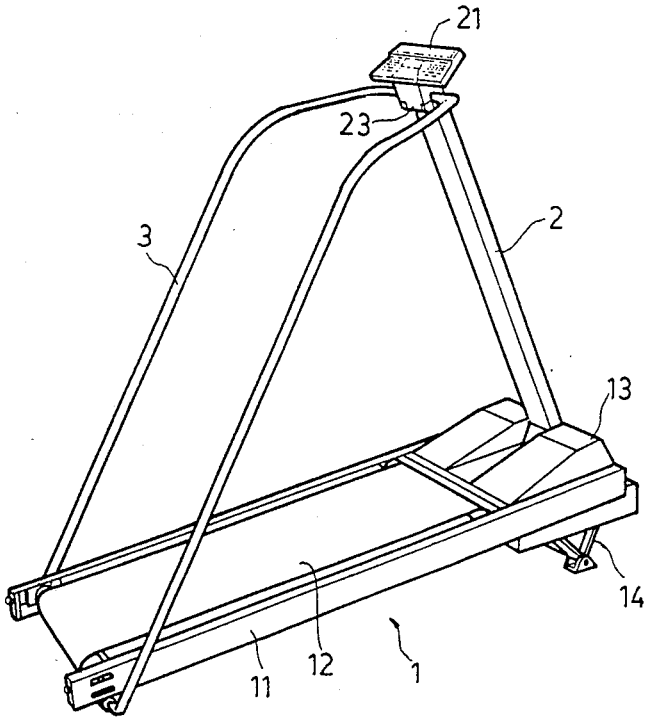
FIG. 1A is a perspective view of the embodiment according to the present invention.
Figure 1B:
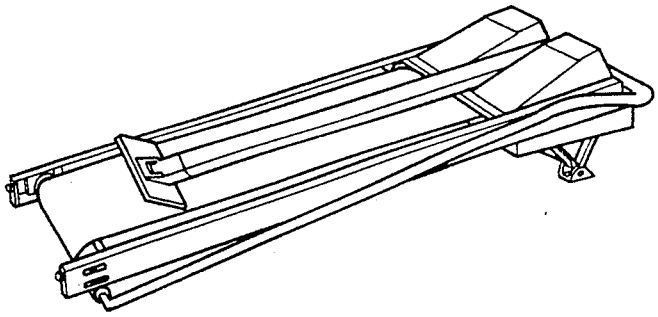
FIG. 1B is a perspective view of the present invention when it is folded up.

Referring to FIG. 1A, it is a perspective view of the treadmill, which comprises mainly a runway 1, a control unit support 2, and a handrail 3. The runway 1 includes a frame 11, a tread belt 12, a driving and transmission mechanism 13, and an adjusting mechanism 14 for the slope of the runway. The lower end of the control unit support 2 is pivotally attached to the front end of the runway 1. The upper end of the control unit support 2 is mounted with a micro-computer control unit 21, under which a snap connection device 23 (to be described in detail hereinafter) is mounted so as to have the handrail 3 and the control unit support 2 set in a detachable manner. The handrail 3 is formed into a reverse-U shape ∩, and the lower two ends of the handrail 3 are pivotally attached to the both sides of the rear end of the runway 1 so as to have the handrail 3 folded on the runway 1 after being detached from the control unit support 2 as shown in FIG. 18.

Figure 2:
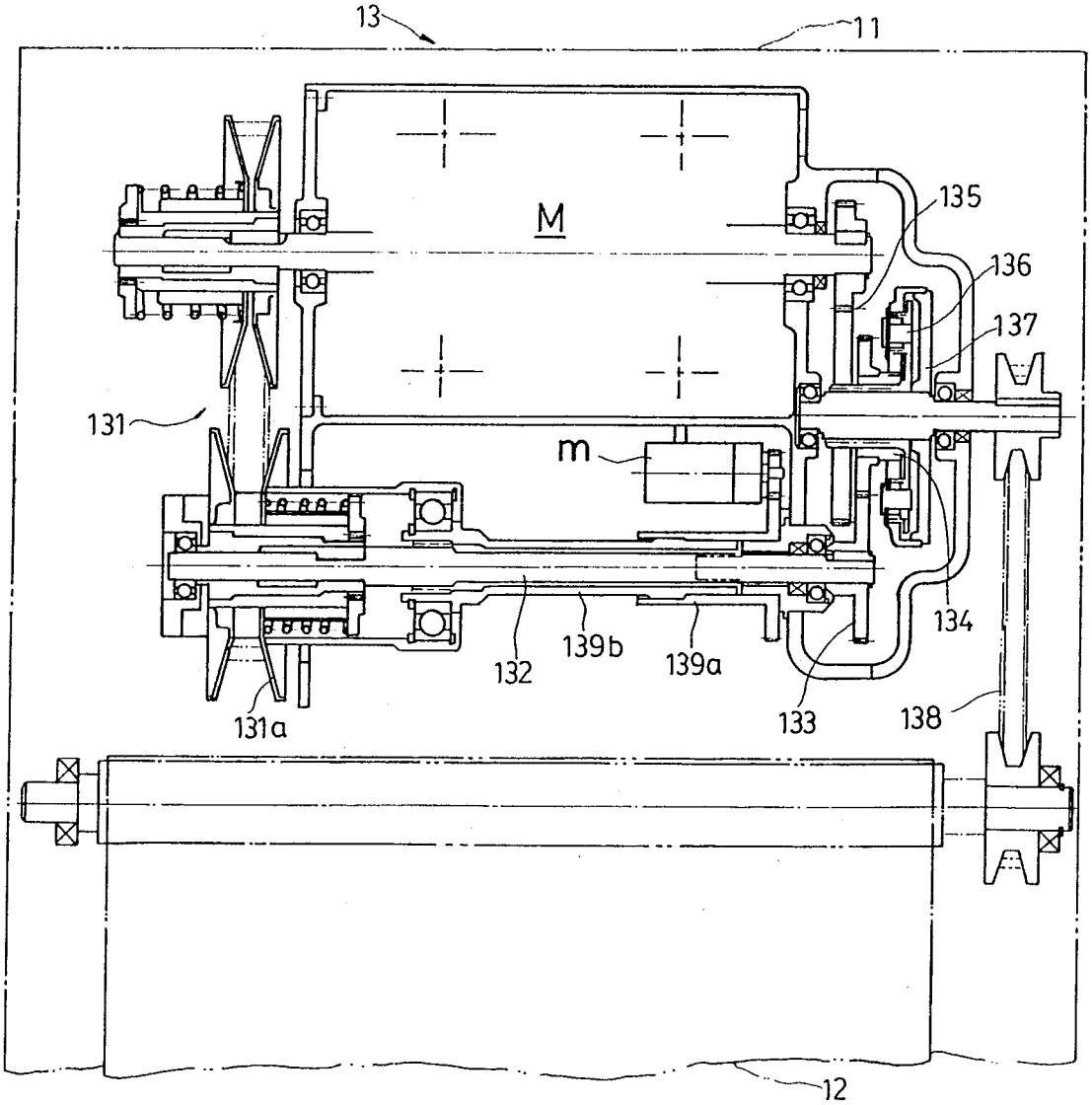
FIG. 2 is a sectional view of the driving and transmission mechanism of the tread belt according to the present invention.

FIG. 2 illustrates a sectional view of the driving and transmission mechanism 13 of the tread belt according to the present invention; the mechanism 13 is mounted in the front part of the frame 11, and it includes a motor M, of which one end of the shaft (the left side shown) is coupled with the V-belt variable transmission assembly 131, the shaft 132 and the gear 133 so as to transmit the power to the center sun gear 134 of the planetary gear set on the right side of the motor. The other end (right side) of the motor M is coupled with the gear train 135 so as to transmit the power too the planet carrier (planet gear shaft) 136, i.e., the differential speed between the sun gear 134 and the planet carrier 136 is to be transferred out through the ring gear 137, pullies and belt 138 for driving the tread belt 12. The speed-changing operation is controlled with a mechanism, in which a reversible motor m, through a reducing gear, drives the sleeves **139*a* rotated on a sleeve 139*b*. The said two sleeves are connected together with threads and the sleeve 139*b* is prevented from rotating. Then, the rotation of the sleeve 139*a* causes the axial movement of the movable plate 131*a* in the transmission assembly 131 through the sleeve 139*b* and a bearing barrel; so as to change the speed ratio of the transmission assembly 131. The output and input rotating speeds of the planetary gear set are designed in the way that the constant rotating speed input of the planet carrier 136 and the variable rotating speed input of the sun gear 134 can be properly fitted in order to obtain an output of rotating speed, for the ring gear 137**, ranging from zero to a given speed; therefore, when the motor M runs at a constant speed, the desired speed output can be obtained by controlling the operation of the motor m.

Figure 3:
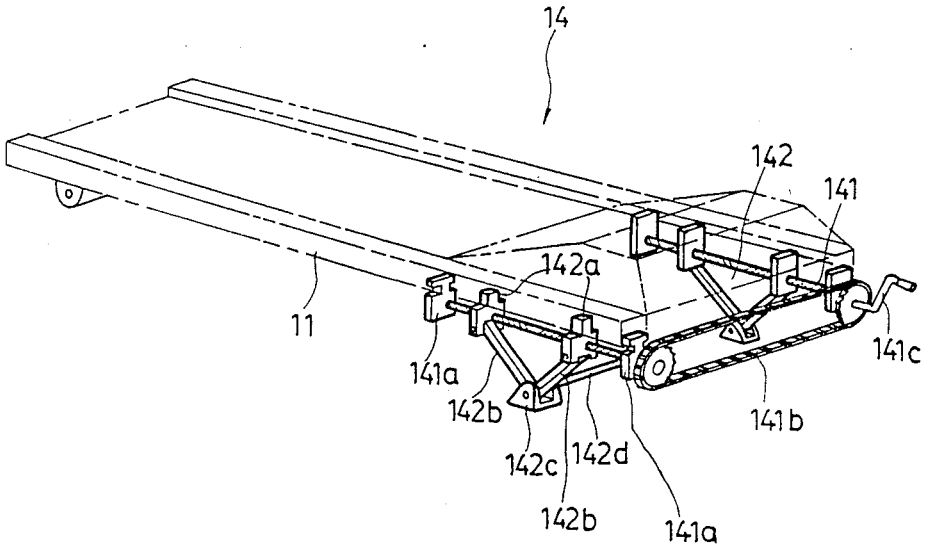
FIG. 3 is a first embodiment of the adjusting mechanism for the slope of the runway according to the present invention.

FIG. 3 illustrates the first embodiment of the adjusting mechanism for the slope of runway according to the present invention, which comprises two sets of the screw rods 141 and two V-shaped joints 142. The two screw rods 141 are mounted in parallel with their supporting seats 141a respectively under the both sides of the front end of the frame 11. The screw rod 141 has two portions of screw threads in the opposite direction; each screw rod has two nuts **142*a* mounted thereon. Each of the nuts 142*a* has a lug being engaged into the sliding groove of the frame 11 in a slidable manner. Upon the screw rod being rotated, the two nuts 142*a* can move closely together or apart from each other. The lower end of the nut 142*a* is pivotally mounted with the arm 142*b*; the lower ends of every two arms 142*b* are pivotally attached to the supporting base 142*c* to be formed into a V-shaped joint. The two V-shaped joints are linked together with the connecting rod 142*d*. The outer ends of the two screw rods 141 are fixedly mounted with two sprockets, which are connected with the chain 141*b*. Upon the two sprockets being driven with the driving means (a crank or a reversible motor) 141*c*,** the two sprockets will rotate synchronously so as to have the two V-shaped joints opened or closed synchronously to change the height of the screw rods relative to the ground, whereby the slope of the runway is adjusted.

Figure 4:
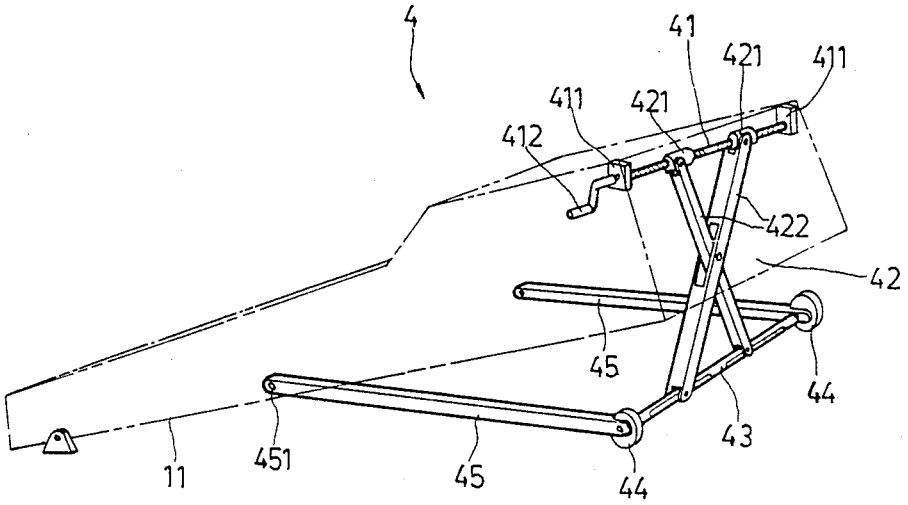
FIG. 4 is the second embodiment of the adjusting mechanism for the slope of the runway according to the present invention.

FIG. 4 illustrates the second embodiment of the adjusting mechanism 4 for the slope of the runway, which comprises a single screw rod and a "X"-shaped joint. The screw rod 41 is also furnished with two portions of threads in the opposite direction, and the both ends of the screw rod 41 are mounted on two supporting seats 411, respectively. Upon the screw rod being rotated with the driving means 412 in the forward or reverse direction, the nuts 421 on the rod 41 will cause the joint arms 422 to move closely or apart from each other. The two joint arms 422 are connected pivotally in their middle portions to form into an "X" shape, while the lower ends thereof are slidably attached to the rod 43. The both ends of the rod 43 are mounted with two supporting members 44 and two swinging arms 45 respectively, while the rear ends 451 of the swinging arms are pivotally attached to the frame 11 so as to limit the movement of the joint mechanism 42 relative to the screw rod 41. Upon the screw rod 41 rotating, the two nuts 421 will be pulled closely or pushed apart to change the angle between the two joint arms so as to adjust its height to the ground; then, the slope of the runway is adjusted.

Figure 5A:
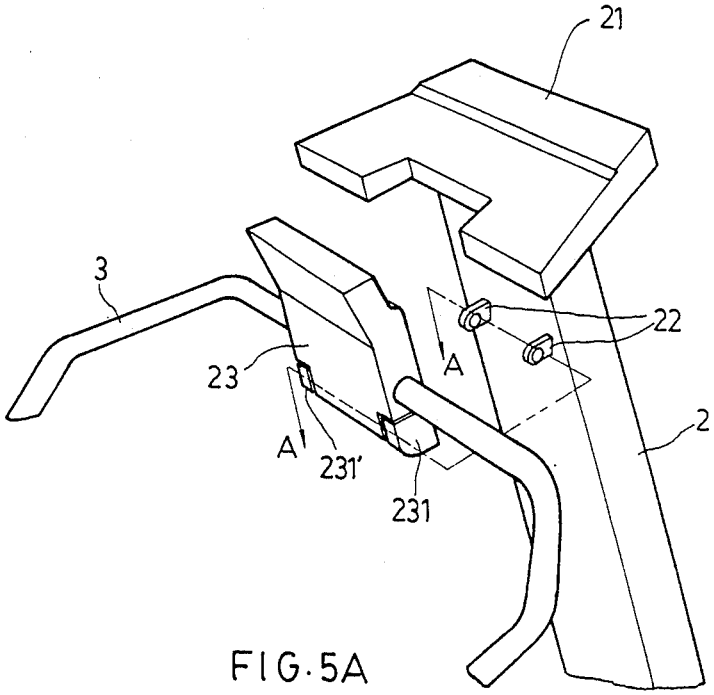
FIG. 5A is a perspective view of the snap connection device between the control unit support and the handrail of the present invention.
Figure 5B:
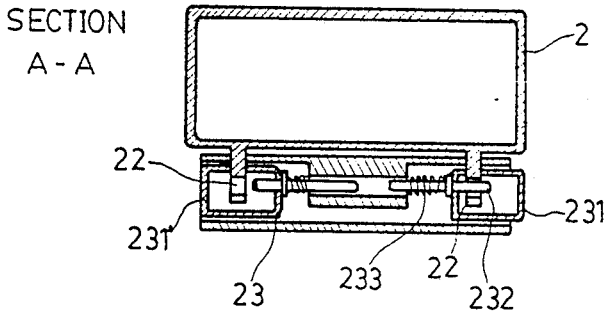
FIG. 5B is a sectional view taken along the line A—A in FIG. 5A.

FIG. 5A is a perspective view of the snap connection device between the control unit support and the handrail according to the present invention. The upper end of the control unit support is mounted with the control unit (operation panel) 21. One side of the support 2 facing the handrail 3 is furnished with two latch lugs 22, which are to be engaged together with the snap connection device 23 on the handrail 3. Both sides of the snap connection mechanism 23 are provided with two release buttons 231 and 231'. In FIG. 5A, the handrail 3 and the support 2 are in a separated position; to engage them together, just push down the two release buttons 231 and 231' to let the two latch lugs 22 insert into the two holes on the back side of the snap connection device 23, and then release the two release buttons 231 and 231'. The operation of the snap connection device 23 is well shown in FIG. 5B, a sectional view taken along the line A—A in FIG. 5A, where the release button 231' is in a released position, while the release button 231 is in a locked position. The inner ends of the two buttons 231 and 231' are fixedly attached to the pins 232 respectively, and the two buttons 231 and 231' are loaded with the springs 233 respectively so as to extend outwards automatically to lock in the latch lugs 22 upon the button being released; upon the buttons being pressed inwards, the latch lugs 22 will be released. The operation space of the buttons 231 and 231' are limited with the retained means (not shown) furnished on the contact surface of the body portion of the snap connection device 23.

Briefly, the present invention has simplified the transmission system of the tread belt by means of a differential stepless transmission and driving mechanism, and has furnished a slope adjusting mechanism by means of a joint mechanism, and has furnished a handrail and a control unit support which can be folded up quickly for storage and shipping convenience. All the aforesaid features make the present invention a simple and practical new running exercise machine.

We claim:

1. A treadmill exercising apparatus, comprising:
   - frame means having longitudinally extending sides and front and rear ends;
   - an endless belt guided by said frame means to provide a runway;
   - means within said frames means for driving said belt;
   - means for adjusting the slope of said frame means relative to a supporting surface including:
     - a screw rod having two oppositely threaded portions rotatably mounted to said front end of said frame means;
     - two nuts, each nut engaged with one of said two threaded portions on said screw rod;
     - an X-shaped joint including two arms rotatably connectedat middle portions of said arms, each of said arms having an upper end and a lower end, each of said upper ends of each arm rotatably mounted to one of said nuts;
     - a swinging member having a first end disposed on the supporting surface and a second end pivotally mounted on said frame means;
     - said lower ends of each of said X-shaped joint arms being slidably attached to said swinging member approximately near said first end of said swinging member; and
     - means for turning said screw rod;
   - a control unit for controlling the operation of the treadmill;
   - a support member on which said control unit is mounted, said support member being pivotally mounted to said frame means near said front end;
   - a reverse U-shaped handrail having its free ends pivotally mounted to said frame means near said rear end; and
   - snap connection means for releasably securing said support member to said handrail including:
     - one or more latch holes formed on said support member, and
     - a latch unit mounted on said handrail including one or more pins receivable in said latch holes, means for biasing each of said pins in a first direction, and release button means for moving each of said pins in a second direction opposite said first direction.

* * * * *